US007991173B2

(12) United States Patent
Ueki

(10) Patent No.: US 7,991,173 B2
(45) Date of Patent: Aug. 2, 2011

(54) WATERPROOF MICROPHONE

(75) Inventor: Masataka Ueki, Joetsu (JP)

(73) Assignee: Uetax Corporation, Joetsu-shi (JP)

( * ) Notice: Subject to any disclaimer, the term of this patent is extended or adjusted under 35 U.S.C. 154(b) by 1219 days.

(21) Appl. No.: 11/317,305

(22) Filed: Dec. 27, 2005

(65) Prior Publication Data

US 2006/0140432 A1 Jun. 29, 2006

(30) Foreign Application Priority Data

Dec. 28, 2004 (JP) ..... P2004-380295

(51) Int. Cl.
*H04R 25/00* (2006.01)

(52) U.S. Cl. ..... 381/174; 381/355; 381/369

(58) Field of Classification Search ..... 381/191, 381/334, 355–369, 170–181
See application file for complete search history.

(56) References Cited

U.S. PATENT DOCUMENTS

| | | | | |
|---|---|---|---|---|
| 3,064,089 A | | 11/1962 | Ward | |
| 3,909,529 A | * | 9/1975 | Morrow et al. | 381/355 |
| 4,582,961 A | * | 4/1986 | Frederiksen | 381/174 |
| 6,111,966 A | * | 8/2000 | Staat et al. | 381/174 |
| 6,512,834 B1 | * | 1/2003 | Banter et al. | 381/386 |
| 2004/0258266 A1 | * | 12/2004 | Staat | 381/353 |

FOREIGN PATENT DOCUMENTS

| | | | |
|---|---|---|---|
| JP | 2001-313990 | | 11/2001 |
| JP | 2001-313990 A | | 11/2001 |
| JP | 02001313990 A | * | 11/2001 |
| JP | 2001313990 A | * | 11/2001 |
| JP | 3486151 B2 | | 1/2004 |

OTHER PUBLICATIONS

European Search Report mailed Mar. 31, 2006 in corresponding EP application No. 05257928.1.

* cited by examiner

*Primary Examiner* — Curtis Kuntz
*Assistant Examiner* — Ryan Robinson
(74) *Attorney, Agent, or Firm* — Nixon & Vanderhye P.C.

(57) ABSTRACT

An anterior wall of a case has a central aperture and two discharge apertures extending from the central aperture. There is an anterior chamber inside the anterior wall. Moisture such as rain water, even if entering the anterior chamber, is smoothly discharged out of the case from the discharge apertures along an inner face of the anterior chamber. As a result, it becomes possible to prevent the moisture from remaining and attaching to a first diaphragm in the anterior chamber and to prevent degradation of sound pressure collected by the first diaphragm through the central aperture and the discharge apertures.

10 Claims, 10 Drawing Sheets

WATERPROOF MICROPHONE

CROSS-REFERENCE TO RELATED APPLICATIONS

This nonprovisional application claims priority under 35 U.S.C. §119(a) on Patent Application No. 2004-380295 filed in Japan on 28 Dec. 2004, the entire contents of which are incorporated herein by reference.

BACKGROUND OF THE INVENTION

The present invention relates to a waterproof microphone (hereinbelow abbreviated to a waterproof mike) allowing sufficient sound collection over wider frequency bands in, for example, high-humidity places exposed to rain and fog, high mountains with low pressure and even under water with high pressure.

Conventionally, a condenser-type waterproof mike includes a cylinder-shaped case, a diaphragm and an electrode plate, where the cylinder-shaped case has an anterior wall, and the diaphragm and the electrode plate are disposed in the case in sequence from the anterior wall side toward the rear side. An anterior chamber is formed between the anterior wall and the diaphragm.

As shown in FIG. 9, the anterior wall 102 of the case 101 had an aperture 102*a* in the center. The aperture 102*a* was not overlapped with an inner face 110*a* of the anterior chamber 110 (see U.S. Pat. No. 3,486,151).

Since the conventional waterproof mike was structured such that the aperture 102*a* was not overlapped with the inner face 110*a* of the anterior chamber 110 as shown in FIG. 9, moisture such as rain water, if entering the anterior chamber 110, is not easily discharged out of the case 101 but remained in the anterior chamber 110. The moisture in the anterior chamber 110 is kept in contact with the diaphragm 120, which causes considerable attenuation of sound pressure collected by the diaphragm. As a result, sufficient sound collection is disadvantageously disturbed.

SUMMARY OF THE INVENTION

An object of the present invention is to provide a waterproof mike allowing sufficient sound collection without being affected by moisture.

To achieve the above-mentioned object, the present invention provides a waterproof mike, comprising:

a cylinder-shaped case having an anterior wall; and a first diaphragm, a second diaphragm and an electrode plate which are disposed in the case in sequence from an anterior wall side toward a rear side, wherein an anterior chamber is formed between the anterior wall and the first diaphragm, a first gap is formed between the first diaphragm and the second diaphragm, a second gap is formed between the second diaphragm and the electrode plate, a posterior chamber is formed behind the electrode plate, the first gap, the second gap and the posterior chamber are linked, the first gap is sealed from the anterior chamber by the first diaphragm, and the anterior wall has a discharge aperture overlapped with an inner face of the anterior chamber.

According to the present invention, moisture such as rain water, if entering the anterior chamber, is smoothly discharged out of the case from the discharge aperture along the inner face of the anterior chamber. As a result, it becomes possible to prevent the moisture from remaining on the first diaphragm and to prevent degradation of sound pressure collected by the first diaphragm. Moreover, the presence of the first diaphragm prevents the moisture in the anterior chamber from entering the first gap.

Moreover, the first gap, the second gap and the posterior chamber are linked, and therefore when pressure in the anterior chamber changes, the pressures in the first gap, the second gap and the posterior chamber become equal in compliance with the change. This prevents the second diaphragm from sinking and staying in contact with the electrode plate, or from protruding and gaining an excessively increased gap with the electrode plate, and allows the second diaphragm to normally vibrate in response to voice so as to achieve sufficient sound collection over wider frequency bands.

Therefore, it becomes possible to provide a waterproof mike achieving sufficient sound collection without being influenced by moisture or air pressure.

In one embodiment of the present invention, the electrode plate has a hole linking the second gap and the posterior chamber, the second diaphragm has a throttle hole linking the first gap and the second gap, and the throttle hole does not substantially transmit dynamic pressure fluctuation in the first gap to the second gap but substantially transmits static pressure fluctuation in the first gap to the second gap.

According to the embodiment of the present invention, when the pressure in the anterior chamber increases or decreases gradually, i.e., increases or decreases statically, from atmospheric pressure, the pressure in the first gap increases or decreases statically in response to this increase or decrease, and this increase or decrease is substantially transmitted to the second gap through the throttle hole in the second diaphragm. Further, the increase or decrease is transmitted to the posterior chamber through the hole in the electrode plate, so that the pressures in the first gap, the second gap and the posterior chamber become equal. The throttle hole in the second diaphragm does not substantially transmit dynamic pressure fluctuation in the first gap, which is caused by voices to be collected, to the second gap, so that the second diaphragm vibrates in response to voice. Therefore, it becomes possible to normally vibrate the second diaphragm in response to voice with simple structure.

In one embodiment of the present invention, the electrode plate has a hole linking the second gap and the posterior chamber, a throttle pathway linking the first gap and the posterior chamber is formed outside lateral faces of the second diaphragm and the electrode plate, and the throttle pathway does not substantially transmit dynamic pressure fluctuation in the first gap to the posterior chamber but substantially transmits static pressure fluctuation in the first gap to the posterior chamber.

According to the embodiment of the present invention, when the pressure in the anterior chamber increases or decreases gradually, i.e., increases or decreases statically, from atmospheric pressure, the pressure in the first gap increases or decreases statically in response to this increase or decrease, and this increase or decrease is substantially transmitted to the posterior chamber through the throttle pathway. Further, the increase or decrease is transmitted to the second gap through the hole in the electrode plate, so that the pressures in the first gap, the second gap and the posterior chamber become equal. The throttle pathway does not substantially transmit dynamic pressure fluctuation in the first gap, which is caused by voices to be collected, to the posterior chamber, so that the second diaphragm vibrates in response to voice. Therefore, it becomes possible to normally vibrate the second diaphragm in response to voice with simple structure.

In one embodiment of the present invention, the waterproof mike further comprises a back plate disposed behind the electrode plate in the case, wherein the back plate has an air hole linking the posterior chamber and an outside of the case.

According to the embodiment of the present invention, even when the pressure in the anterior chamber changes, the pressure in the posterior chamber and the pressure outside the case become equal with the presence of the air hole in the back plate. More particularly, the pressures in the anterior chamber, the first gap, the second gap and the posterior chamber become equal. Thus, deformation of the first diaphragm may be suppressed even when the pressure outside the case changes.

In one embodiment of the present invention, the waterproof mike further comprises a polymeric film having air permeability disposed on a rear face of the back plate.

According to the waterproof mike in one embodiment, the polymeric film allows only air to be inducted into or discharged from the case.

In one embodiment of the present invention, a thickness of the first diaphragm is identical to or small than a thickness of the second diaphragm.

According to the waterproof mike in one embodiment, when low frequencies are applied to the first diaphragm, resonance of the second diaphragm by vibration of the first diaphragm may be prevented.

In one embodiment of the present invention, the discharge aperture is present in plural, and the discharge apertures are disposed along the inner face of the anterior chamber.

According to the embodiment of the present invention, moisture entering the anterior chamber may be smoothly discharged out of the case from the discharge apertures, which allows more sufficient sound collection.

According to the waterproof mike of the present invention, the anterior wall of the case has the discharge apertures overlapped with the inner face of the anterior chamber, which allows sufficient sound collection without being influenced by moisture.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The Present invention will be described in detailed below based on embodiments thereof.

First Embodiment

Figure 1A:
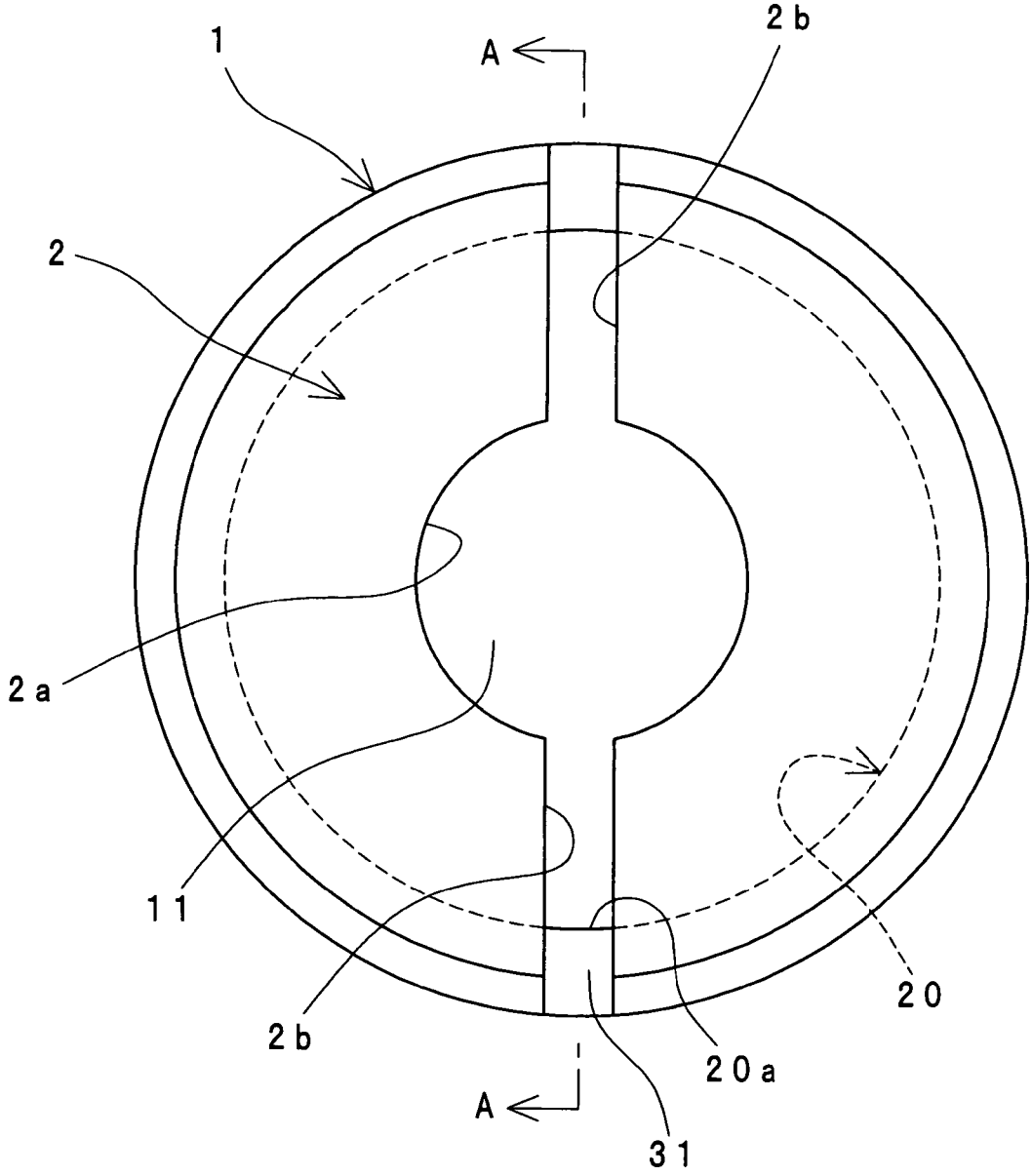
FIG. 1A is a front view showing a waterproof mike in a first embodiment of the present invention.
Figure 1B:
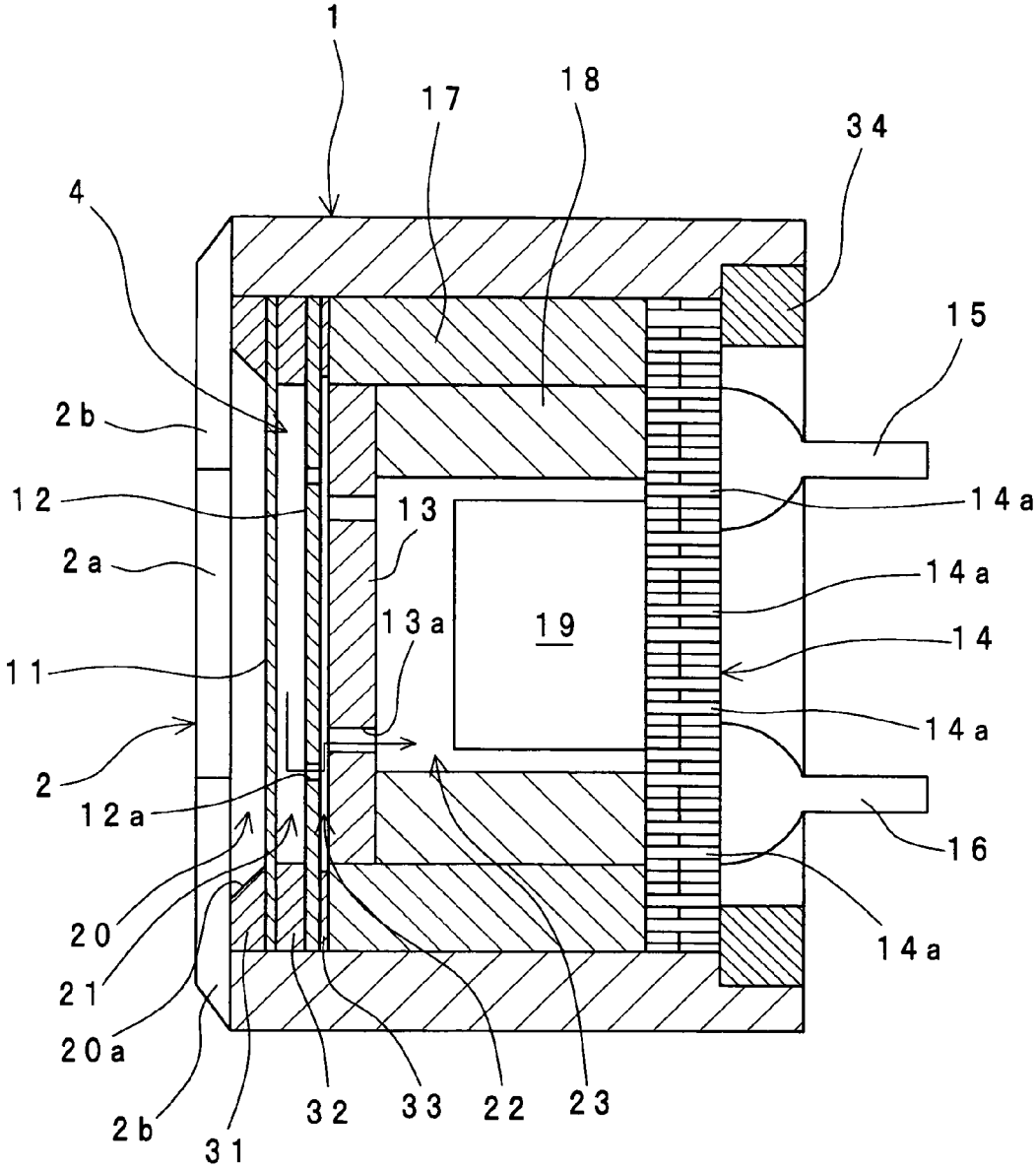
FIG. 1B is a cross sectional view taken along line A-A in FIG. 1A.

FIG. 1A is a front view showing a waterproof mike in a first embodiment of the present invention. FIG. 1B is a cross sectional view taken along line A-A in FIG. 1A. This waterproof mike is a so-called condenser-type microphone, which has a cylinder-shaped case 1 having an anterior wall 2, and a first diaphragm 11, a second diaphragm 12, an electrode plate 13 and a back plate 14. The first diaphragm 11, the second diaphragm 12, the electrode plate 13 and the back plate 14 are disposed in the case 1 in sequence from the anterior wall 2 side toward the rear side.

An anterior chamber 20 is formed between the anterior wall 2 and the first diaphragm 11. A first gap 21 is formed between the first diaphragm 11 and the second diaphragm 12. A second gap 22 is formed between the second diaphragm 12 and the electrode plate 13. A posterior chamber 23 is formed between the electrode plate 13 and the back plate 14.

The first diaphragm 11 is made of metals such as aluminum, iron, stainless and copper or resins such as plastic. The first diaphragm 11 is mounted on the rear face of a first ring 31. The first ring 31 is retained in the case 1 by the anterior wall 2.

The second diaphragm 12 is formed by evaporating metal on a synthetic resin plate and permanently charging its surface. For example, the second diaphragm 12 is made of a so-called electret material having a permanently charged surface. The second diaphragm 12 is mounted on the rear face of a second ring 32. The second diaphragm 12 has a throttle hole 12*a* linking the first diaphragm 11 and the second diaphragm 12.

The electrode plate 13 has a hole 13*a* linking the second gap 22 and the posterior chamber 23. A circular insulator 17 is disposed on the inner face of the case 1, and the electrode plate 13 is disposed on the inner face of the insulator 17.

The back plate 14 has an air hole 14*a* linking the posterior chamber 23 and the outside of the case 1. The back plate 14 is made of, for example, PCB (Poly Chlorinated Biphenyl). The back plate 14 is in contact with an axial rear end face of the insulator 17.

A conversion module 19 is mounted on the front face of the back plate 14, while a plus output terminal 15 and a minus output terminal 16 are mounted on the rear face of the back plate 14.

A conductive plate 18 is disposed between the electrode plate 13 and the back plate 14 and on the inner face of the insulator 17. A spacer 33 is disposed between the second diaphragm 12 and the insulator 17.

The back plate 14 is retained in the case 1 by a circular holder 34. The holder 34 is bonded to the inner face of the case 1 with, for example, waterproof adhesives. The first ring 31 is also bonded to the inner face of the case 1 with, for example, waterproof adhesives.

Thus, the first gap 21, the second gap 22 and the posterior chamber 23 are linked. Moreover, the first gap 21 is sealed from the anterior chamber 20 by the first diaphragm 11. More particularly, the anterior chamber 20 and the first gap 21 are not linked to each other.

The anterior wall 2 has a central aperture 2*a* and two discharge apertures 2*b*, 2*b* extending in two radial directions from the central aperture 2*a*. The central aperture 2*a* is in an almost circular shape while the discharge apertures 2*b* are in an almost rectangular shape. More particularly, these two discharge apertures 2*b*, 2*b* extend radially from the inner face of the central aperture 2*a* to the peripheral edge of the anterior wall 2.

The discharge apertures 2*b* are overlapped with an inner face 20*a* of the anterior chamber 20. More particularly, the inner face 20*a* of the anterior chamber 20 corresponds to the inner face of the first ring 31.

The throttle hole 12*a* of the second diaphragm 12 is so set as to have a diameter which does not substantially (purposefully) transmit dynamic pressure fluctuation in the first gap 21 (caused by voice and the like) to the second gap 22, but substantially transmit static pressure fluctuation in the first gap 21 (caused by gradual increase in altitude or water depth) to the second gap 22.

The second diaphragm 12, the electrode plate 13 and the like constitute a sound pressure-electrical signal conversion section 4. The conversion module 19 equalizes an impedance in the sound pressure-electrical signal conversion section 4 caused by voice and the like to an impedance in an external output-side circuit.

Figure 2:
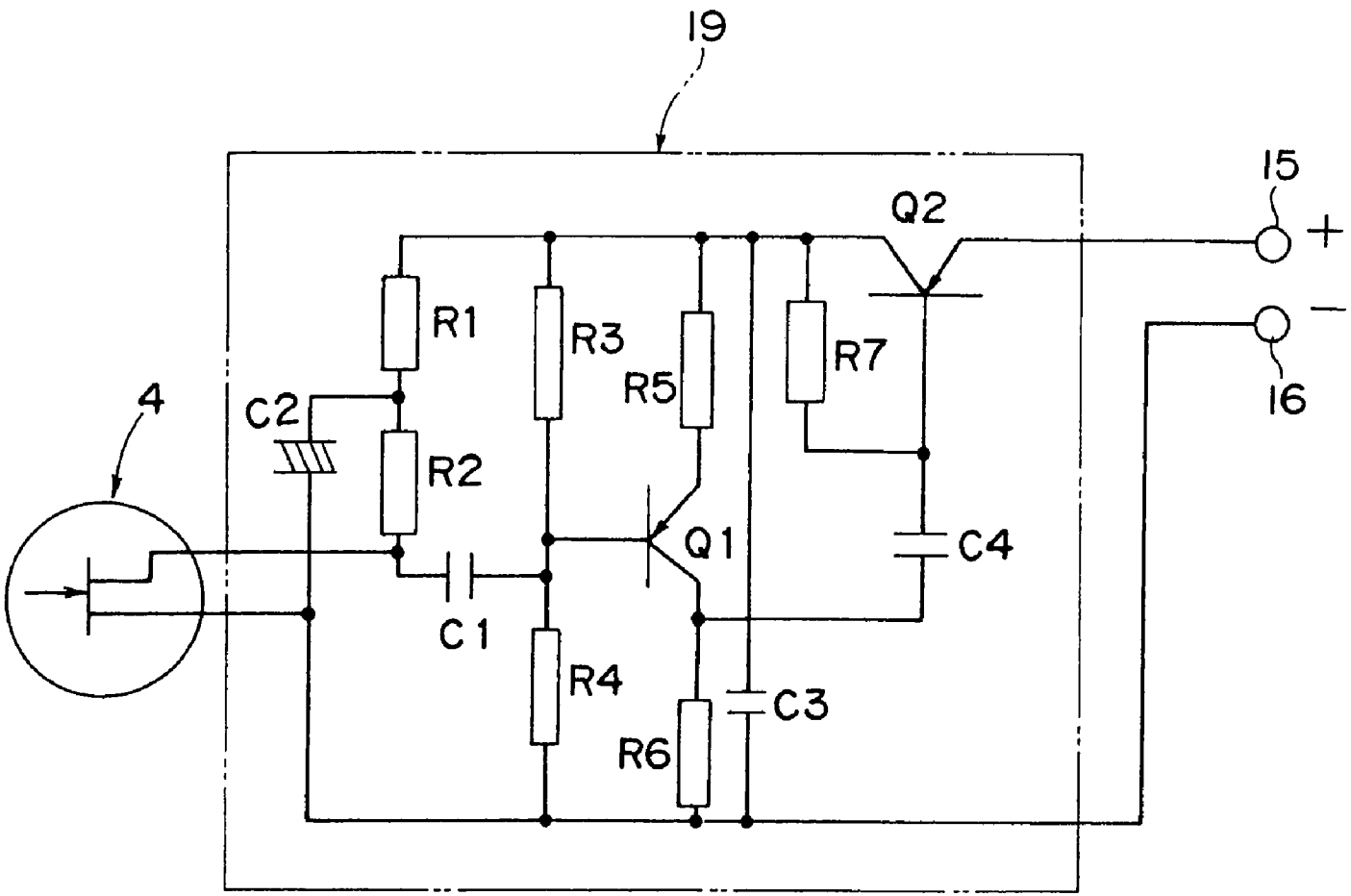
FIG. 2 is a circuitry view showing a conversion module.

As shown in the circuitry view in FIG. 2, the conversion module 19, which has resistances R1 to R7, capacities C1 to C4, and two-stage transistors Q1, Q2 constituting an emitter follower, amplifies weak electric signals inputted from the sound pressure-electrical signal conversion section 4 and equalizes a high impedance in the sound pressure-electrical signal conversion section 4 and a low impedance in signal lines and speakers connected to the output terminals 15, 16, so that an output impedance of the waterproof mike is reduced to not more than 100 Ω. Consequently, it was confirmed that when the output signal line was prolonged to about 200 m, voice signals could be transmitted sufficiently. Moreover, the conversion module 19 employs two-line transmission method in which the plus output terminal 15 is used also as a power supply line to the sound pressure-electrical signal conversion section 4, which brings about an advantage that the structure is simplified compared to the three-line method.

According to the thus-structured waterproof mike, moisture such as rain water, if entering the anterior chamber 20, is smoothly discharged out of the case 1 from the discharge apertures 2*b* along the inner face 20*a* of the anterior chamber 20. As a result, it becomes possible to prevent the moisture from remaining and sticking on the first diaphragm 11 and to prevent degradation of sound pressure collected by the first diaphragm 11 through the central aperture 2*a* and the discharge apertures 2*b*. Moreover, the presence of the first diaphragm 11 prevents the moisture in the anterior chamber 20 from entering the first gap 21.

Moreover, the first gap 21, the second gap 22 and the posterior chamber 23 are linked, and therefore when pressure in the anterior chamber 20 changes, the pressures in the first gap 21, the second gap 22 and the posterior chamber 23 become equal in compliance with the change. This prevents the second diaphragm 12 from sinking and staying in contact with the electrode plate 13, or from protruding and gaining an excessively increased gap with the electrode plate 13, and allows the second diaphragm to normally vibrate in response to voice so as to achieve sufficient sound collection over wider frequency bands.

More specifically, when the pressure in the anterior chamber 20 increases gradually, i.e., increases statically, from atmospheric pressure, the pressure in the first gap 21 increases statically in response to this increase, and compressed air is substantially transmitted to the second gap 22 through the throttle hole 12*a* in the second diaphragm 12 as shown by an arrow in FIG. 1B. Further, the compressed air is transmitted to the posterior chamber 23 through the hole 13*a* in the electrode plate 13, so that the pressures in the first gap 21, the second gap 22 and the posterior chamber 23 become equal. The throttle hole 12*a* in the second diaphragm 12 does not substantially transmit dynamic pressure fluctuation in the first gap 11 and the first gap 21, which is caused by voices to be collected, to the second gap, so that the second diaphragm 12 vibrates in response to voice. It is to be noted that when the pressure in the anterior chamber 20 is decreased from atmospheric pressure, air flows in direction opposite to the arrow in FIG. 1B.

Therefore, it becomes possible to provide a waterproof mike achieving sufficient sound collection without being influenced by moisture or air pressure. Sufficient sound collection over wider frequency bands can be made even in, for example, high-humidity places exposed to rain and fog, high mountains with low pressure and under water with high pressure. Moreover, the waterproof mike may be used for sound collection in highways, nuclear devices and in tunnels. The waterproof mike may also be employed as radio transceiver microphones and communication microphones during operation on ship decks.

Moreover, even when the pressure in the anterior chamber 20 changes, the pressure in the posterior chamber 23 and the pressure outside the case 1 become equal with the presence of the air hole 14*a* in the back plate 14. More particularly, the pressures in the anterior chamber 20, the first gap 21, the second gap 22 and the posterior chamber 23 become equal. Thus, when the pressure outside the case 1 changes, deformation of the first diaphragm 11 may be suppressed.

The thickness of the first diaphragm 11 should preferably be equal to or smaller than the thickness of the second diaphragm 12, so that when low frequencies are applied to the first diaphragm 11, resonance of the second diaphragm 12 by vibration of the first diaphragm 11 may be prevented.

Further, forming the first diaphragm 11 so as to be roundish and protrude forward or backward makes it possible to secure specified frequency regions, which allows obtention of good characteristics.

It is to be noted that a cover cloth for covering the front face of the anterior wall 2 may be placed to prevent dirt and the like from entering the anterior chamber 20.

Second Embodiment

Figure 3A:
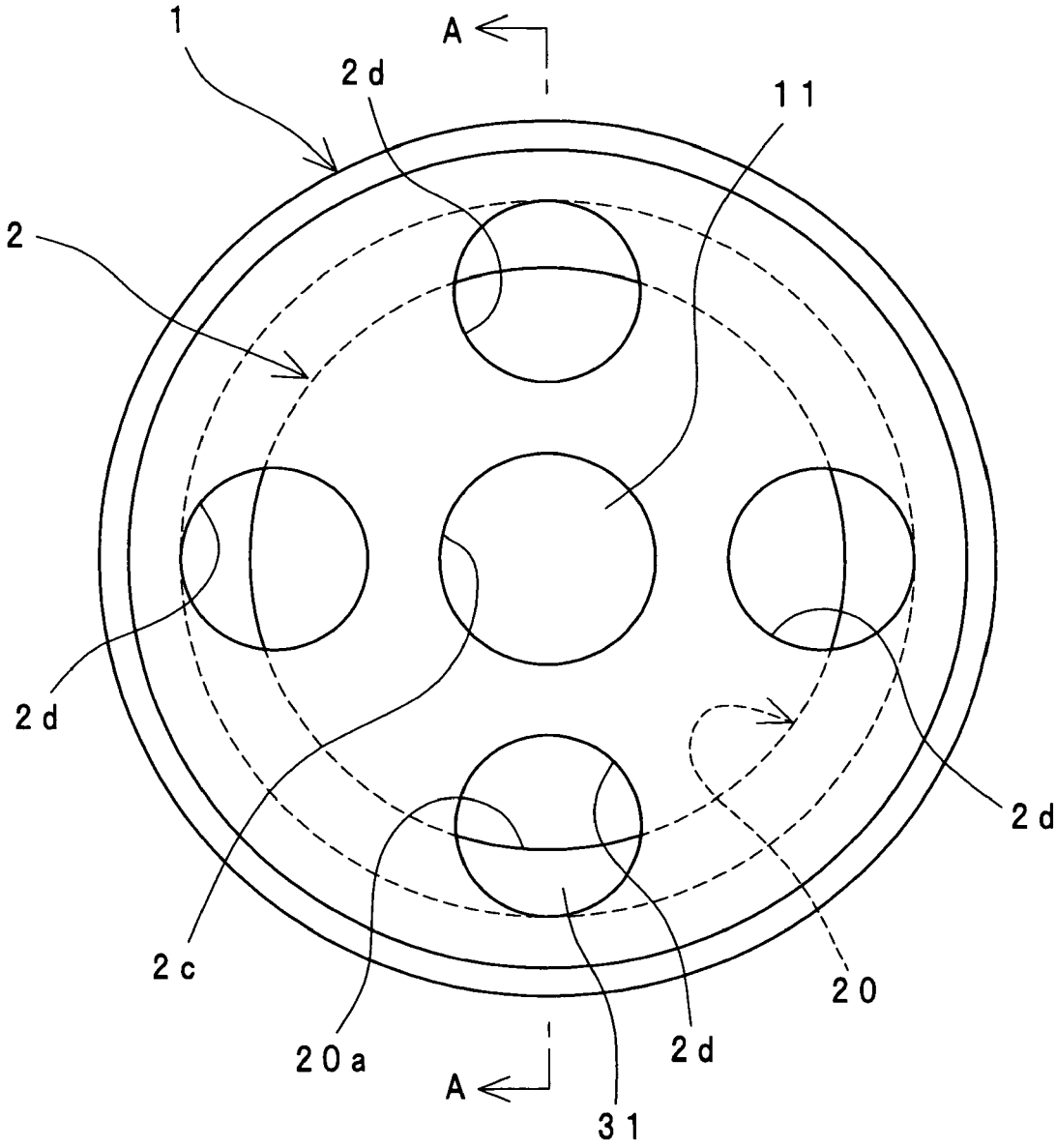
FIG. 3A is a front view showing a waterproof mike in a second embodiment of the present invention.
Figure 3B:
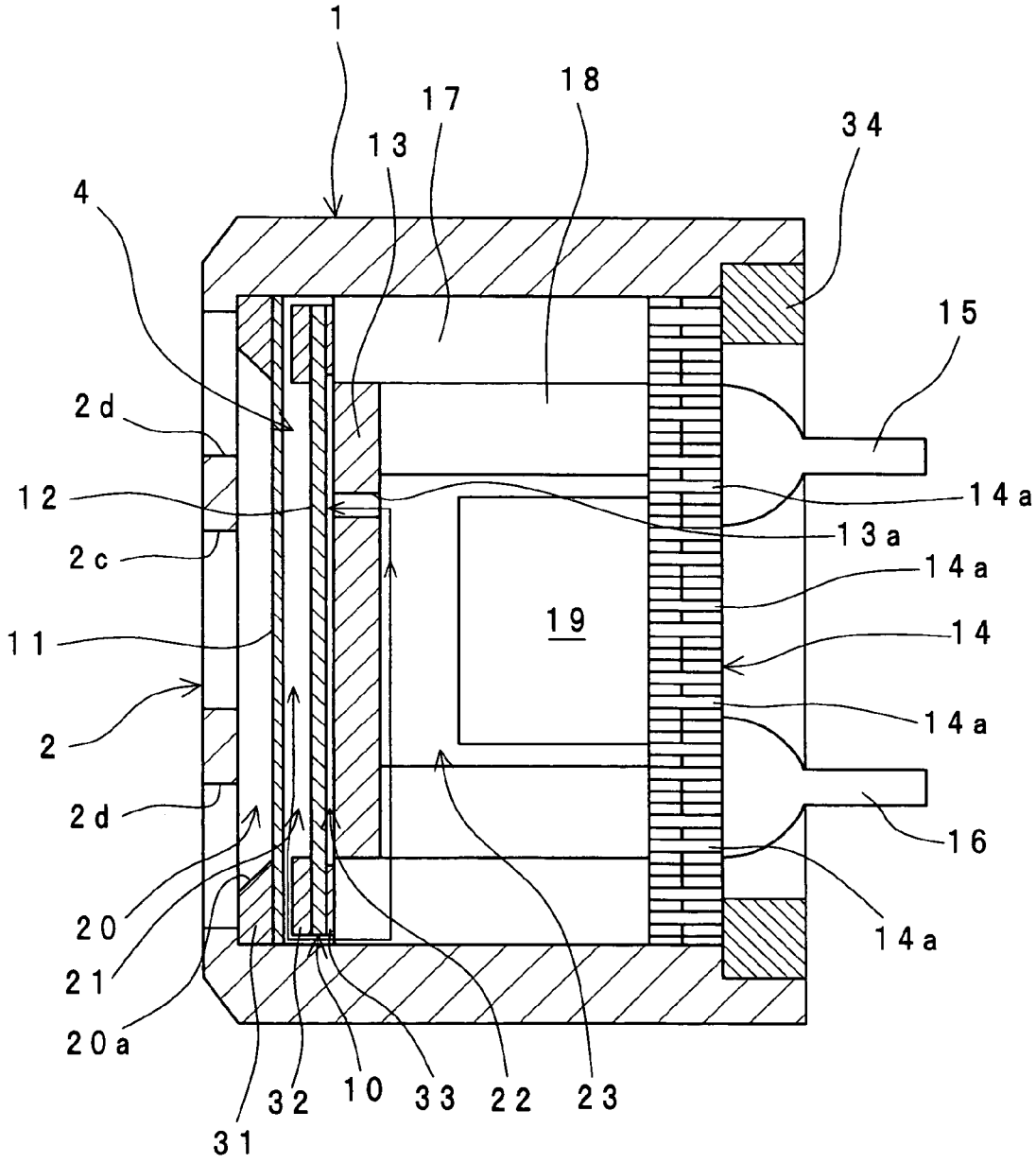
FIG. 3B is a cross sectional view taken along line A-A in FIG. 3A.

FIG. 3A and FIG. 3B show a waterproof mike in a second embodiment of the present invention. The second embodiment is different from the first embodiment in the point that the anterior wall 2 of the case 1 has a central aperture 2*c* and four discharge apertures 2*d* disposed at almost even intervals along the inner face 20*a* of the anterior chamber 20. The inner face 20*a* of the anterior chamber 20 are overlapped with the discharge apertures 2*d*. The central aperture 2*c* are formed in an almost circular shape and the discharge apertures 2*d* are formed in an almost circular shape. The central aperture 2*c* is away from the discharge apertures 2*d*.

Thus, moisture entering the anterior chamber 20 may be smoothly discharged out of the case 1 from a plurality of the discharge apertures 2*d* through the inner face 20*a* of the anterior chamber 20, which allows more sufficient sound collection.

Moreover, in the second embodiment, the electrode plate 13 has a hole 13*a* linking the second gap 22 and the posterior chamber 23. A throttle pathway 10 linking the first gap 21 and the posterior chamber 23 is formed outside the lateral faces of the second diaphragm 12 and the electrode plate 13. The throttle pathway 10 does not substantially transmit dynamic pressure fluctuation in the first gap 21 to the posterior chamber 23, but substantially transmits static pressure fluctuation in the first gap 21 to the posterior chamber 23.

The throttle pathway 10 includes gaps between the outer peripheral faces of the second ring 32, the second diaphragm 12, the spacer 33 and the electrode plate 13 and the inner face of the case 1. Moreover, the insulator 17 and the electrode plate 18 are not in a circular shape but are, for example, columns having a circular arc cross section and are provided in a plurality of units. There are gaps between adjacent insulators 17. There are gaps between adjacent electrode plates 18.

When the pressure in the anterior chamber 20 increases gradually, i.e., increases statically, from atmospheric pressure, the pressure in the first gap 21 increases statically in response to this increase, and compressed air is substantially transmitted to the posterior chamber 23 through the throttle pathway 10, gaps between the adjacent insulators 17, and gaps between the adjacent electrode plates 18 in this order as shown by an arrow in FIG. 3B. Further, the compressed air is transmitted to the second gap 22 through the hole 13*a* on the electrode plate 13, so that the pressures in the first gap 21, the second gap 22 and the posterior chamber 23 become equal. The throttle pathway 10 does not substantially transmit dynamic pressure fluctuation in the first gap 11 and the first gap 21, which is caused by voice to be collected, to the posterior chamber 23, so that the second diaphragm 12 vibrates in response to voice. It is to be noted that when the pressure in the anterior chamber 20 is decreased from atmospheric pressure, air flows in direction opposite to the arrow in FIG. 3B.

It is to be noted that the insulator 17 and the electrode plate 18 may be in a circular shape and have a groove and a hole so as to link the throttle pathway 10 and the posterior chamber 23.

Third Embodiment

Figure 4:
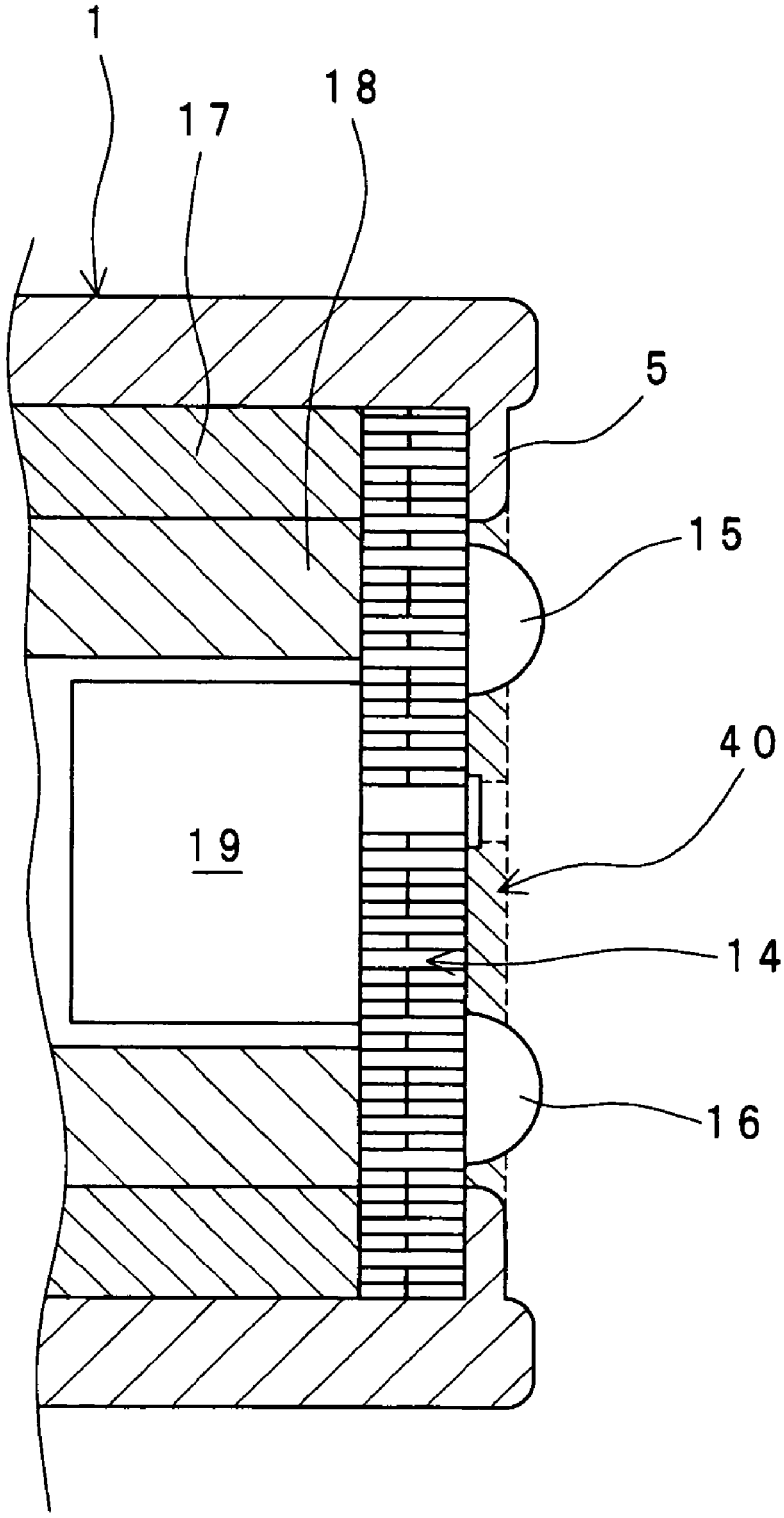
FIG. 4 is a cross sectional view showing the main part of a waterproof mike in a third embodiment of the present invention.

FIG. 4 shows a waterproof mike in a third embodiment of the present invention. The third embodiment is different from the first embodiment in the point that a polymeric film 40 is placed on the rear face of the back plate 14. Thus, the polymeric film 40 allows only air to be inducted into or discharged from the case 1.

Moreover, in the third embodiment, the back plate 14 is retained in the case 1 with a caulking portion 5 disposed in a rear aperture end of the case 1. This makes it possible to reduce the number of components.

Fourth Embodiment

Figure 5:
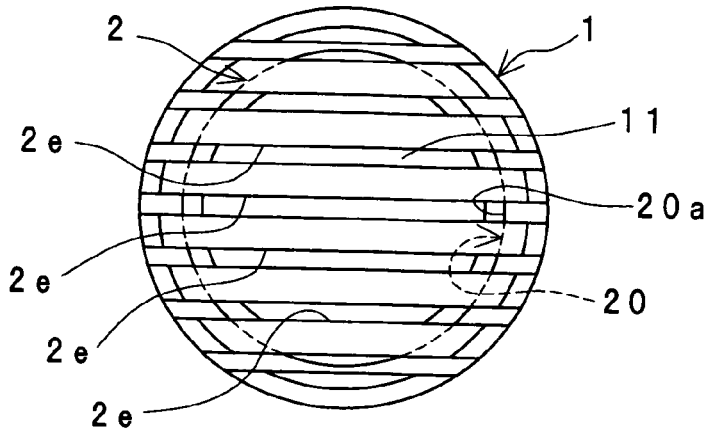
FIG. 5 is a front view showing a cross sectional view in a fourth embodiment of the present invention.

FIG. 5 shows a waterproof mike in a fourth embodiment of the present invention. The fourth embodiment of the present invention is different from the first embodiment in the point that the anterior wall 2 has a plurality of discharge apertures 2*e* juxtaposed at even intervals in radial direction. The discharge apertures 2*e* are in an almost rectangular shape extending sideways so as to cross the peripheral edge of the anterior wall 2. The anterior wall 2 does not have the central aperture 2*a* of the first embodiment. The discharge apertures 2*e* are overlapped with the inner face 20*a* of the anterior chamber 20.

Thus, the anterior wall 2 (discharge apertures 2*e*) may be simply structured while reliable sound collection and water discharge may be achieved.

Fifth Embodiment

Figure 6:
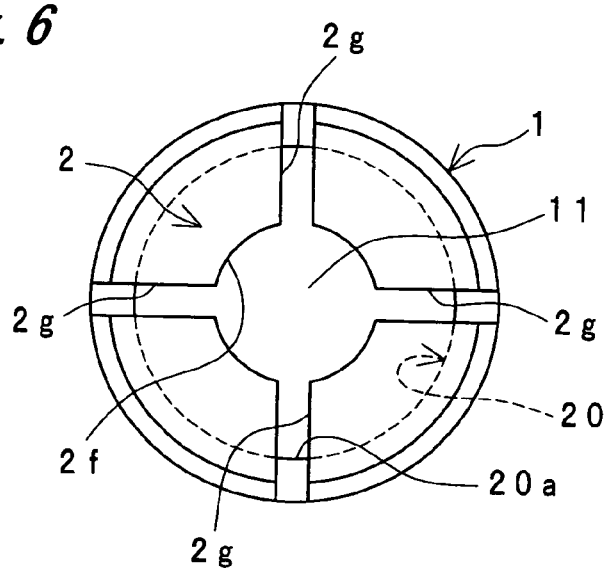
FIG. 6 is a front view showing a waterproof mike in a fifth embodiment of the present invention.

FIG. 6 is a waterproof mike in a fifth embodiment of the present invention. The fifth embodiment of the present invention is different from the first embodiment in the point that the anterior wall 2 has a central aperture 2*f* and four discharge apertures 2*g* extending in four radial direction from the central aperture 2*f*. A plurality of the discharge apertures 2*g* are positioned at almost even intervals in circumferential direction. The central aperture 2*f* is in an almost circular shape, while the discharge apertures 2*g* are in an almost rectangular shape. More particularly, these four discharge apertures 2*g* extend radially from the inner face of the central aperture 2*f* to the peripheral edge of the anterior wall 2. The discharge apertures 2*g* are overlapped with the inner face 20*a* of the anterior chamber 20.

Thus, increasing the number of the discharge apertures 2*g* allows more sufficient sound collection and water discharge.

Sixth Embodiment

Figure 7:
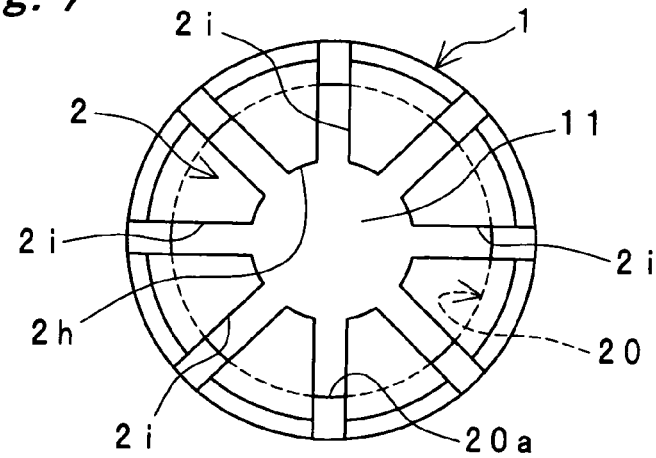
FIG. 7 is a front view showing a waterproof mike in a sixth embodiment of the present invention.

FIG. 7 shows a waterproof mike in a sixth embodiment of the present invention. The sixth embodiment of the present invention is different from the first embodiment in the point that the anterior wall 2 has a central aperture 2*h* and eight discharge apertures 2*i* extending in eight radial directions from the central aperture 2*h*. A plurality of the discharge apertures 2*i* are positioned at almost even intervals in circumferential direction. The central aperture 2*h* is in an almost circular shape, while the discharge apertures 2*i* are in an almost rectangular shape. More particularly, these eight discharge apertures 2*i* extend radially from the inner face of the central aperture 2*h* to the peripheral edge of the anterior wall 2. The discharge apertures 2*i* are overlapped with the inner face 20*a* of the anterior chamber 20.

Thus, increasing the number of the discharge apertures 2*i* allows more sufficient sound collection and water discharge.

Seventh Embodiment

Figure 8A:
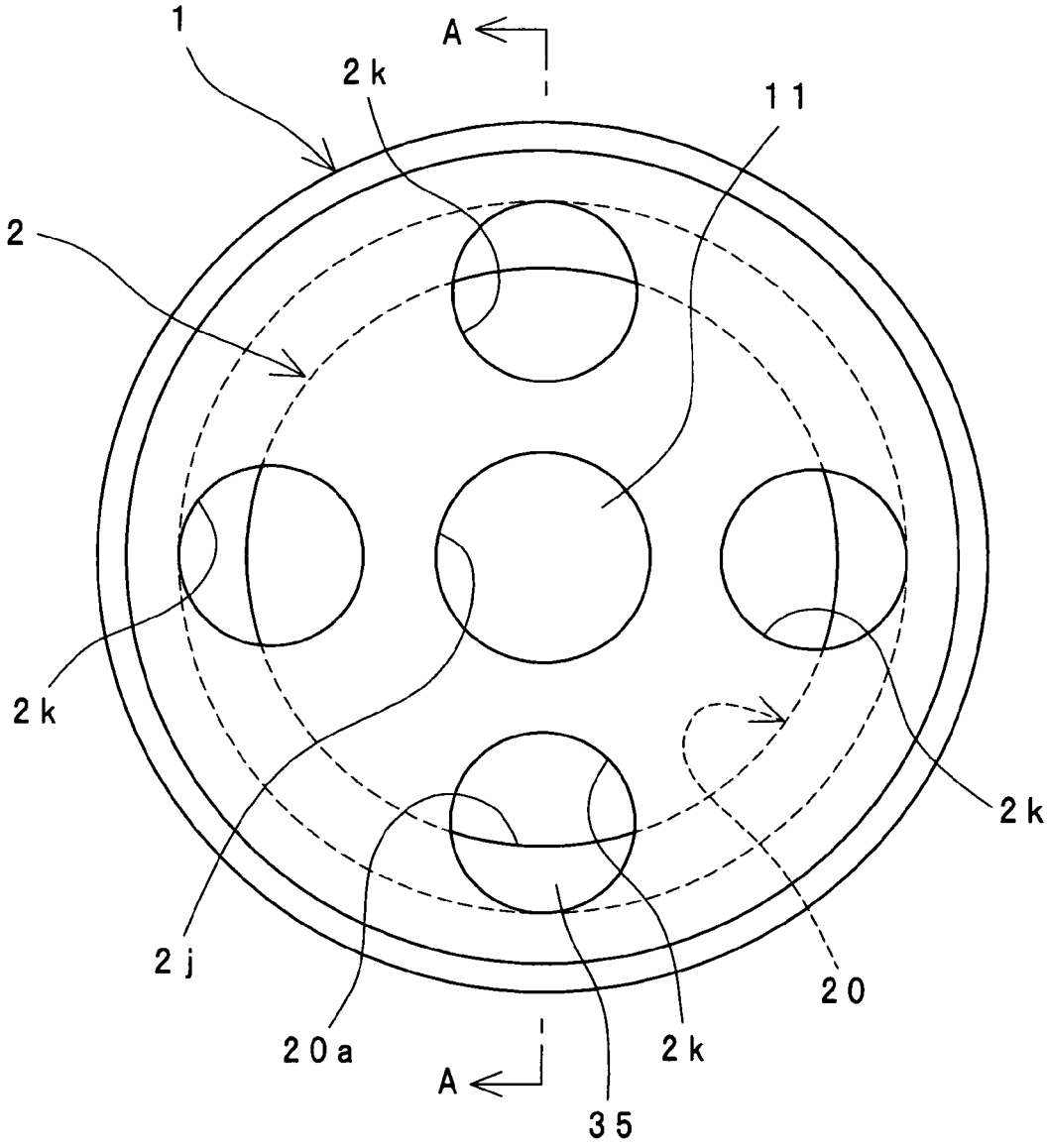
FIG. 8A is a front view showing a waterproof mike in a seventh embodiment of the present invention.
Figure 8B:
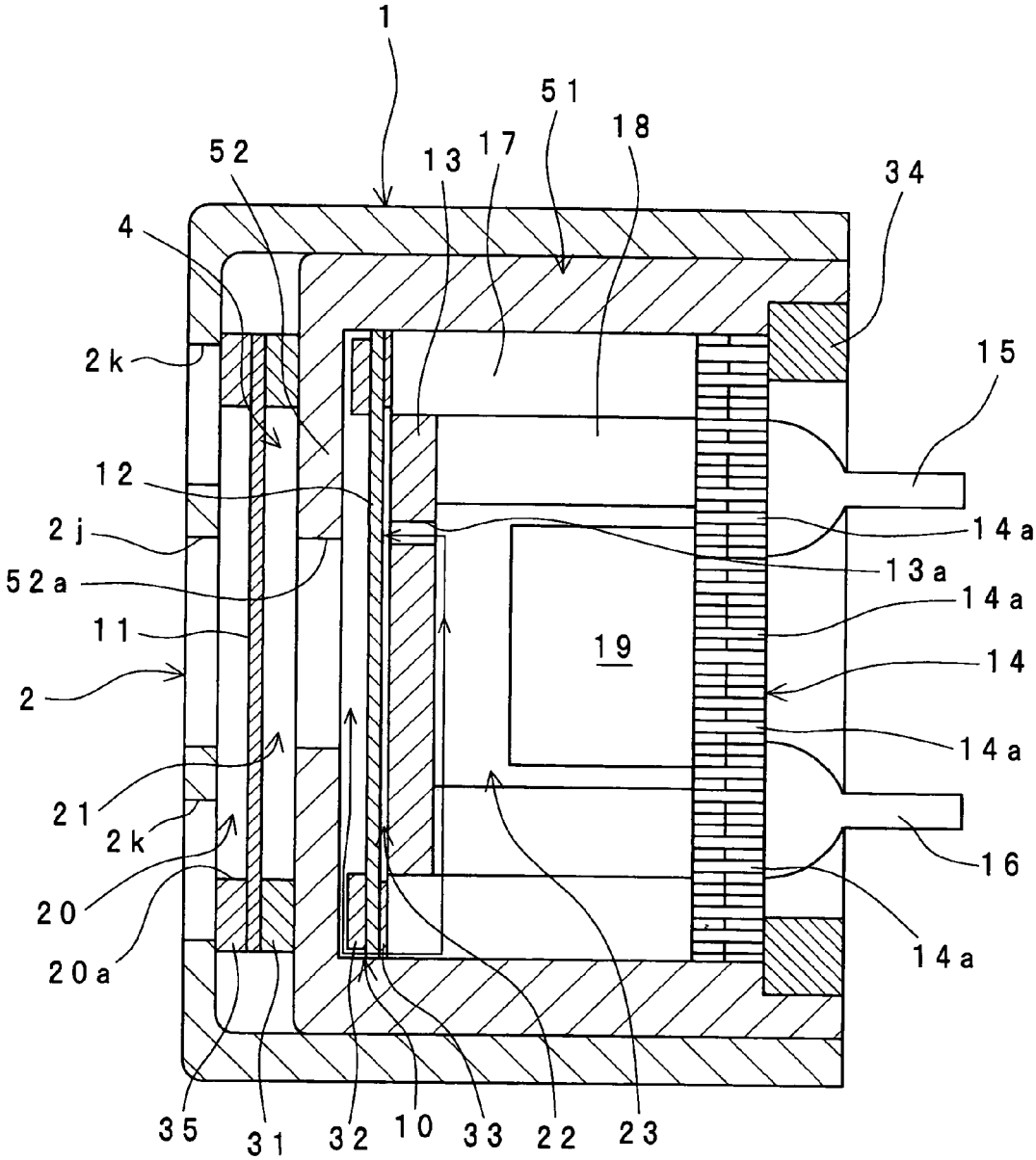
FIG. 8B is a cross sectional view taken along line A-A in FIG. 8A.
Figure 9:
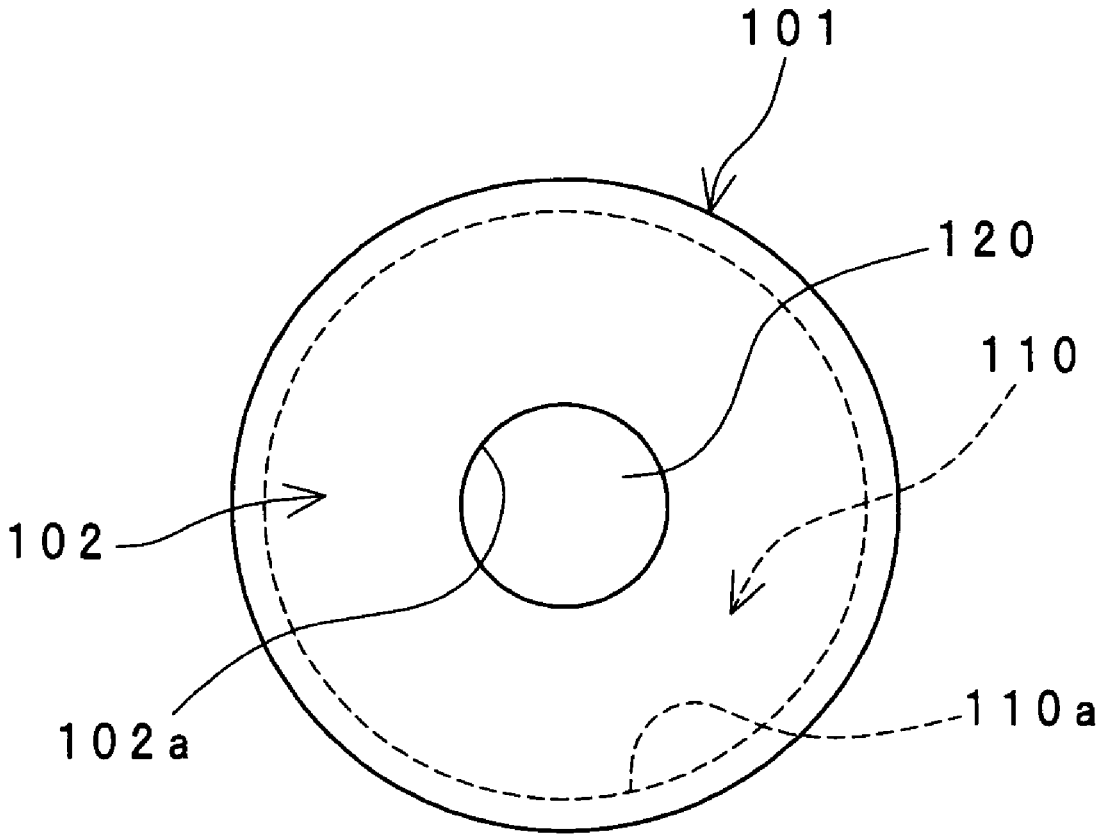
Fig. 9 PRIOR ART
FIG. 9 is a front view showing a conventional waterproof mike.

FIG. 8A and FIG. 8B show a waterproof mike in a seventh embodiment of the present invention. The seventh embodiment is different from the second embodiment in the point that an inner case 51 is placed inside the case 1. The inner case 51 has an anterior wall 52 facing the anterior wall 2 of the case 1. The anterior wall 52 of the inner case 51 has a central aperture 52*a*.

Inside the inner case 51, the second ring 32, the second diaphragm 12, the spacer 33, the electrode plate 13, the electrode plate 18, the back plate 14 and the holder 34 are disposed in sequence from the anterior wall 52 of the inner case 51 to the rear side. Moreover, the insulator 17 is disposed between the spacer 33 and the back plate 14.

A gap is present between the anterior wall 2 of the case 1 and the anterior wall 52 of the inner case 51, and in this gap, a spacer 35, the first diaphragm 11 and the first ring 31 are disposed in sequence from the anterior wall 2 of the case 1 to the rear side.

The first diaphragm 11 covers the central aperture 52*a* on the anterior wall 52 of the inner case 51. The first ring 31 is bonded to the front face of the anterior wall 52 of the inner case 51 with, for example, waterproof adhesives.

More particularly, the anterior chamber 20 is formed between the anterior wall 2 of the case 1 and the first diaphragm 11. The first gap 21 is formed between the first diaphragm 11 and the second diaphragm 12. The first gap 21 is sealed from the anterior chamber 20 by the first diaphragm 11.

The throttle pathway 10 includes gaps between the outer peripheral faces of the second ring 32, the second diaphragm 12, the spacer 33 and the electrode plate 13 and the inner face of the inner case 51. Moreover, the insulator 17 and the electrode plate 18 are not in a circular shape but are, for example, columns having a circular arc cross section and are provided in a plurality of units. There are gaps between adjacent insulators 17. There are gaps between adjacent electrode plates 18.

When the pressure in the anterior chamber 20 increases gradually, i.e., increases statically, from atmospheric pressure, the pressure in the first gap 21 increases statically in response to this increase, and compressed air is substantially transmitted to the posterior chamber 23 through the throttle pathway 10, gaps between the adjacent insulators 17, and gaps between the adjacent electrode plates 18 in this order as shown by an arrow in FIG. 8B. Further, the compressed air is transmitted to the second gap 22 through the hole 13*a* on the electrode plate 13, so that the pressures in the first gap 21, the second gap 22 and the posterior chamber 23 become equal. The throttle pathway 10 does not substantially transmit dynamic pressure fluctuation in the first gap 11 and the first gap 21, which is caused by voice to be collected, to the posterior chamber 23, so that the second diaphragm 12 vibrates in response to voice. It is to be noted that when the pressure in the anterior chamber 20 is decreased from atmospheric pressure, air flows in direction opposite to the arrow in FIG. 8B.

The anterior wall 2 of the case 1 has a central aperture 2*j* and four discharge apertures 2*k* disposed at almost even intervals along the inner face 20*a* of the anterior chamber 20. The inner face 20*a* of the anterior chamber 20 are overlapped with the discharge apertures 2*k*. The central aperture 2*j* is in an almost circular shape, and the discharge apertures 2*k* are in an almost circular shape. The central aperture 2*j* is away from the discharge apertures 2*k*.

Thus, the waterproof mike in the seventh embodiment has the inner case 51, which increases strength. Moreover, since the spacer 35 is present between the anterior wall 2 of the case 1 and the first diaphragm 11, the anterior chamber 20 is sufficiently secured, which prevents moisture from being attached to the first diaphragm 11 and allows moisture, if entering the anterior chamber 20, to be smoothly discharged out of the case 1 from the discharge apertures 2*k*. Moreover, the anterior wall 52 of the inner case 51 is present between the first diaphragm 11 and the second diaphragm 12, which prevents the first diaphragm 11 from coming into accidental contact with the second diaphragm 12.

It is to be understood that the present invention is not limited to the embodiments disclosed. For example, the conversion module 19 may have a plurality of equalizers corresponding to frequency bands to be received, a pressure sensor, and a control section for selecting and operating the equalizers based on detection signals of the pressure sensor. Consequently, the pressure sensor detects the pressure in the case 1 increasing corresponding to water depth, and based on the detection signal, the control section selects and operates the equalizer which converts a frequency band of collected sound signals of, for example, conversation under water to a normal frequency band of the voice heard on land. More particularly, with use a selected appropriate equalizer, the waterproof mike can correct characteristics and sensitivity of collected sound signals attributed to sound wave transmission characteristics different by media.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

The invention claimed is:

1. A waterproof microphone comprising:

a cylinder-shaped case having an anterior wall; and a first diaphragm, a second diaphragm and an electrode plate which are disposed in the case in sequence from an anterior wall side toward a rear side, wherein an anterior chamber is formed between the anterior wall and the first diaphragm, a first gap is formed between the first diaphragm and the second diaphragm, a second gap is formed between the second diaphragm and the electrode plate, a posterior chamber is formed behind the electrode plate, a conversion module is housed in the tosterior chamber, where in the conversion module equalizes an impedance of a sound pressure-electrical signal generated by the second diaphragm and electrode plate with an impedance of an external circuit, the first gap, the second gap and the posterior chamber are linked by air passages in the second diaphragm and the electrode plate, the first gap is sealed from the anterior chamber by the first diaphragm, and the anterior wall has a discharge aperture overlapped with an inner face of the anterior chamber, and a back plate disposed behind the electrode plate and in front of the posterior chamber in the case, wherein the back plate has an air hole linking the posterior chamber and an outside of the case, and the air hole is one of the air passages.

2. The waterproof microphone as defined in claim 1, wherein the air passages include a hole in the electrode plate linking the second gap and the posterior chamber and a throttle hole in the second diaphragm linking the first gap and the second gap, and the throttle hole does not substantially transmit dynamic pressure fluctuations in the first gap to the second gap but does substantially transmit static pressure fluctuations in the first gap to the second gap.

3. The waterproof microphone as defined in claim 1, further comprising a polymeric film having air permeability disposed on a rear face of the back plate.

4. The waterproof microphone as defined in claim 1, wherein a thickness of the first diaphragm is identical to or smaller than a thickness of the second diaphragm.

5. The waterproof microphone as defined in claim 1, wherein the discharge aperture is a plurality of discharge apertures, and the plurality discharge apertures are disposed along the inner face of the anterior chamber.

6. A waterproof microphone as in claim 1 wherein the discharge aperture extends radially outward from a central region of the inner face of the anterior chamber to beyond a periphery of the anterior chamber.

7. A waterproof microphone as in claim 1 wherein the discharge aperture includes at least one radially outwardly extending slot in the anterior wall.

8. A waterproof microphone as in claim 1 wherein the discharge aperture includes at least one slot extending from a central region of the anterior wall to a periphery of the anterior wall.

9. A waterproof microphone as in claim 1 wherein the inner face of the anterior chamber includes a region proximate to the discharge aperture, wherein the region slopes radially outward to the discharge aperture.

10. A waterproof microphone as in claim 1 wherein the inner face of the anterior chamber slopes radially outward such that the inner face has a diameter adjacent the first diaphragm which is smaller than a diameter of the inner face adjacent the anterior wall.

* * * * *